United States Patent [19]

Chan-Son-Lint et al.

[11] Patent Number: 4,768,001

[45] Date of Patent: Aug. 30, 1988

[54] MICROWAVE PHASE SHIFTER WITH PIEZOELECTRIC CONTROL

[75] Inventors: Bernard Chan-Son-Lint, St Orens De Gameville; Pierre Borderies; Christian J. Pouit, both of Toulouse, all of France

[73] Assignee: Office National d'Etudes et de Recherches Aerospatiales (ONERA), Chatillon, France

[21] Appl. No.: 857,767

[22] Filed: Apr. 29, 1986

[30] Foreign Application Priority Data

Apr. 30, 1985 [FR] France ..... 85 06536

[51] Int. Cl.[4] ..... H01P 1/18; H01Q 3/26; H01Q 3/32; H01Q 13/00

[52] U.S. Cl. ..... 333/159; 333/157; 333/248; 343/768; 343/771; 343/778; 343/785

[58] Field of Search ..... 333/156, 157, 159, 239, 333/240, 248; 343/700 R, 762, 770, 772, 778, 785, 767, 768, 771

[56] References Cited

U.S. PATENT DOCUMENTS 4,575,697 3/1986 Rao et al. ..... 333/248 X

OTHER PUBLICATIONS

Klohn, Kenneth L., "Metal Walls in Close Proximity to a Dielectric Waveguide Antenna"; IEEE Transactions on Microwave Theory and Techniques; vol. MTT-29, No. 9, Sep. 1981; pp. 962–966.

Jacobs, Harold and Chrepta, Metro M., "Electronic Phase Shifter for Millimeter-Wave Semiconductor Dielectric Integrated Circuits"; IEEE Transactions on Microwave Theory and Techniques, vol. MTT-22, No. 4, Apr. 1974; pp. 411–417.

*Primary Examiner*—Marvin L. Nussbaum

*Attorney, Agent, or Firm*—Lowe, Price, LeBlanc, Becker & Shur

[57] ABSTRACT

A microwave phase shifter comprise a dielectric waveguide having a flat side and a moving conductor plane member substantially parallel to the waveguide side. Piezoelectric means are provided to move the plane member with respect to the waveguide side between a portion relatively remote from the waveguide side and an other position substantially in contact with the waveguide side. The piezoelectric means consists preferably of a stack of piezoelectric members supplied by a variable d.c. power source. Owing to the piezoelectric means for moving the conductor plane member, a variable phase shift is continuously adjusted. Such a phase shifter can be as an antenna network when the dielectric waveguide contains groups of radiator perturbations, such as conductor strips, respectively controlled by one or several piezoelectric means carrying conductor plates facing waveguide portions including the perturbations groups.

25 Claims, 6 Drawing Sheets

MICROWAVE PHASE SHIFTER WITH PIEZOELECTRIC CONTROL

BACKGROUND OF THE INVENTION

1. Field of the Invention

The present invention relates to a microwave phase shifter and more especially a millimeter-wave phase shifter containing a dielectric waveguide, a conductor reflector plane parallel to one of sides of the waveguide and piezoelectric means for adjusting the distance between the reflector plane nd the waveguide.

Apart from a dielectric waveguide phase shifter with piezoelectric control, the invention concerns dielectric waveguide and variable radiation pattern or lobe scanning antennae, in which the phase shifter contains periodical perturbations.

2. Description of the Prior Art

The article "Electronic Phase Shifter for Millimeter-Wave Semiconductor Dielectric Integrated Circuits" by Harold JACOBS and Metro M. CHREPTA, IEEE, transactions on microwave theory and techniques, Vol. MTT-22, No. 4, April 1974, pages 411 to 417, establishes that the presence of a metal plane placed on an upper side of a dielectric guide transforms this latter into an image guide. This article discloses an approximate calculation by the MARCATILI method to evaluate the propagation constant in the guide in the two extreme conditions: totally dielectric guide when the conductor plane is infinitely remote, and an image guide when the conductor plane is directly placed on one side of the guide. No calculation is made in this article on the general case, showing the variation in the propagation constant in the guide as a function of the distance of the conductor plane to the dielectric guide side.

An attempt has been made to obtain a variation in the propagation constant via an electronic control using strips of p-i-n diodes spaced regularly apart and integrated on one side of the dielectric waveguide. When the diodes are forward-biased, the intrinsic regions of the p-i-n diodes behave as a conductor plane, and when the diodes are reverse-biased, i.e. do not conduct, they simulate a state in which no conductor plane is present. Dielectric waveguide devices and p-i-n diode strips have been described in the aforesaid article and in the article "Metal Walls In Close Proximity to a Dielectric Waveguide Antenna" by Kenneth L. KLOHN, IEEE transactions on microwave theory and techniques, Vol. MTT-29, No. 9, September 1981, pages 962–966.

The principle consisting in simulating the presence or absence of a conductor plane by p-i-n diodes is theoretically a good one. Nevertheless, in practice, despite the injection of carriers in the intrinsic region of the diodes, the diodes do not perfectly conduct especially with millimeter-waves. This explains the disappointing result obtained with these phase shifters such as a phase shifting limited to 35°/cm at 70 GHz. Moreover this type of phase shifter cannot be used to create a continuously variable phase shift. In fact, for low diode biases implying a little phase shift, the intrinsic region behaves like a dielectric with very heavy losses.

OBJECTS OF THE INVENTION

The main object of this invention is to provide a dielectric waveguide phase shifter in which a variable phase shift is continously adjusted.

Another object of this invention is to provide a dielectric waveguide phase shifter including piezoelectric means for moving a conductor reflector plane with respect of a dielectric waveguide to obtain a variable phase shift.

Still another object of this invention is to provide an antenna network including a dielectric waveguide having radiator perturbations whose radiation pattern are controlled by piezoelectric means carrying a metal plate placed in the proximity of waveguide portions contained the perturbations.

A further object of this invention is to provide an antenna network including a plurality of parallel dielectric waveguides having radiator perturbation groups whose radiation pattern and lobe scanning are controlled by piezoelectric means carrying a conductor reflector plate facing the waveguide.

SUMMARY OF THE INVENTION

According to the objects of this invention, a microwave phase shifter comprises a dielectric waveguide having a flat side and a moving conductor plane member substantially parallel to the waveguide side. Piezoelectric means are provided to move the plane member with respect to the waveguide side between a portion relatively remote from the waveguide side and another position substantially in contact with the waveguide side. The piezoelectric means consists preferably of a stack of piezoelectric members supplied by a variable d.c. power source.

The phase shifter embodying invention offers several advantages:

A phase shifting is fully reciprocal.

A phase shifting per unit of length of the guide is very high. Around a frequency of 94 GHz, phase shifting of 360°/cm can be obtained with a 20 micron movement of the conductor reflector plane member when the dielectric waveguide have a relative dielectric permittivity that is high, for example $\epsilon_r \approx 10$.

Insertion losses are extremely low. An insulated dielectric guide, of alumina-air type, has insertion losses of about 15 to 20 dB/m around 94 GHz, corresponding to losses of about 0.15 to 0.2 dB/cm.

Amplitude modulation is negligible on varying the phase shift from 0° to 360°; the insertion losses vary little according to the very low losses of the device.

The phase shifter offers great flexibility in the choice of the phase shift slope in terms of the movement of the reflector plane. This slope can be 360°/cm/20 microns in the case of an insulating dielectric guide of alumina-air type, and 360°/cm/300 microns when a dielectric, such as Teflon, having a relatively low permittivity is used.

BRIEF DESCRIPTION OF THE DRAWING

The foregoing and other objects, features and advantages of the invention will be apparent from the following detailed description of several preferred embodiments of the invention with reference to the corresponding accompanying drawings in which.

DESCRIPTION OF THE PREFERRED EMBODIMENTS

Figure 1:
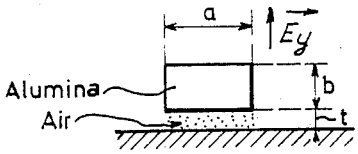
FIG. 1 shows the rectangular section of an alumina-air dielectric image waveguide together with a variable position reflector plane.

In FIG. 1 is shown a rectangular bar cross-section of a dielectric waveguide having a width a and a height b, and a reflector plane parallel to a large side of the waveguide and spaced at a distance t from the large side.

A strict calculation using the fields connection method plots dispersion curves providing standardized propagation constant $k_z/k_0$ in terms of $bk_0$, when $k_0=2''/0$ denotes the propagation constant in air and b denotes the height of the dielectric bar. The thickness of a small air space between the dielectric bar and the reflector plane is denoted as parameter t. The curves obtained are indicated on FIG. 2.

Figure 4:
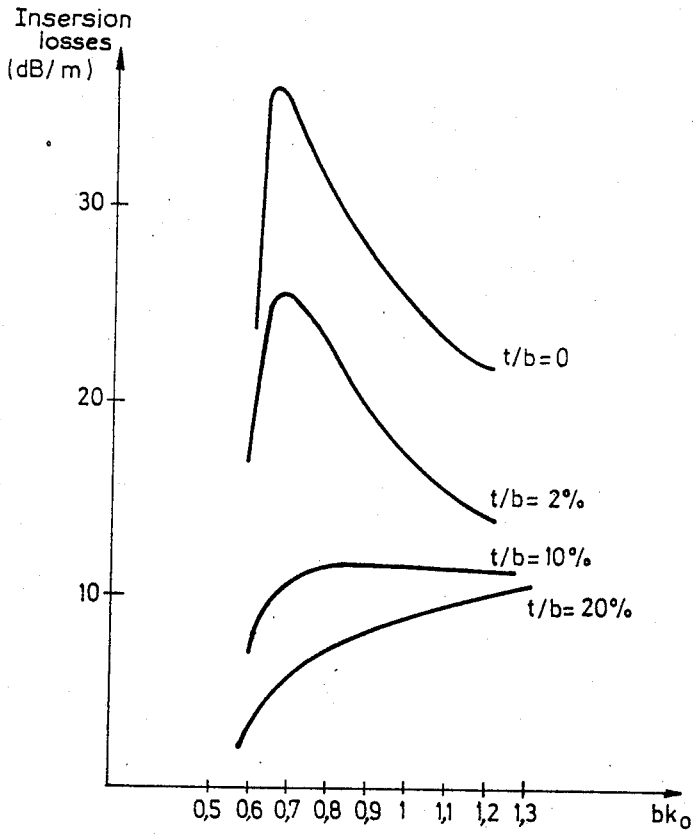
FIG. 4 shows the insertion losses in decibels per meter in terms of the height b of a small side of the guide with a given wavelength λ and several values of the guide-reflector plane distance t.

The insertion losses in decibels per meter, corresponding to the sum of the dielectric and conductor losses, in terms of $bk_0$ for different values of t/b, are shown in FIG. 4. An impedance defined by $V^2/2P$ as a function of $bk_0$ with t/b as parameter, is indicated on FIG. 5. Values V and P are defined by the following relations:

$$V = \int_0^C E_y(x=0)\,dy$$

$$P = \tfrac{1}{2}\int\int_S Re\,(E_yH_x^* - E_xH_y^*)\,dx\,dy$$

in which:

$E_y$=electrical field along direction $\overrightarrow{Oy}$ perpendicular to the reflector plane;

$E_x$=electrical field along direction $\overrightarrow{Ox}$ parallel to the reflector plane;

$H^*_x$=conjugate magnetic field along $\overrightarrow{Ox}$;

$H^*_y$=conjugate magnetic field along $\overrightarrow{Oy}$;

C=parameter inserted into the method of calculation by connection of fields, generally C≅4b;

P=power transmitted by the waveguide;

S=surface of the straight section of the waveguide;

Re indicates the real portion of a complex quantity.

Figure 2:
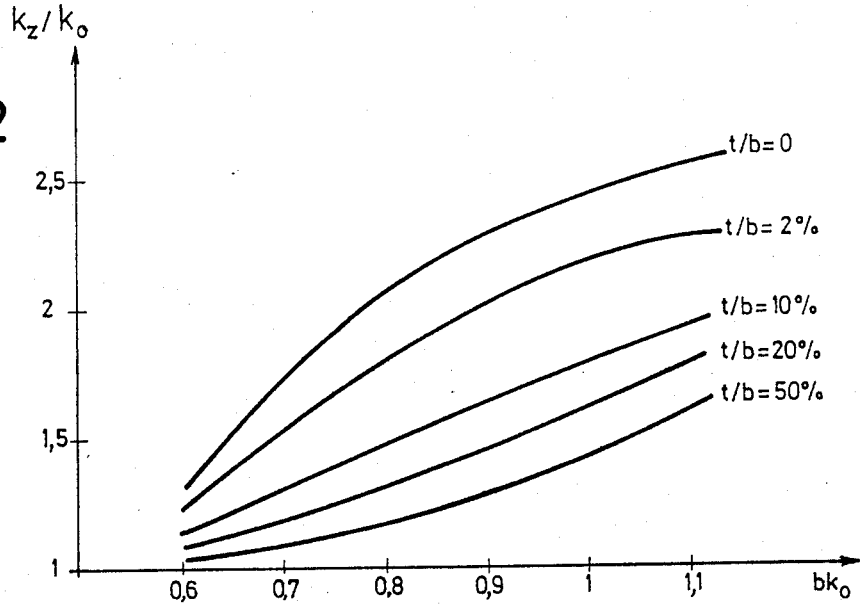
FIG. 2 shows dispersion curves of the guide in FIG. 1 providing variations of a standardized propagation constant $k_z/k_0$ in the fundamental mode as a function of a product $bk_0$ of a waveguide size or height b and the propagation constant in air, for several predetermined values of a ratio t/b of a distance t between the waveguide and the reflector plane, and said size b.
Figure 3:
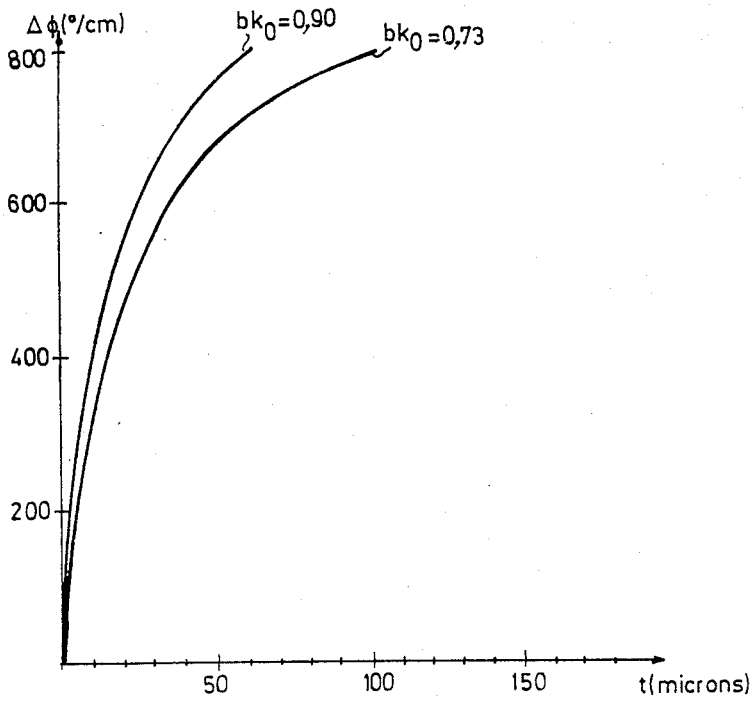
FIG. 3 shows variations in the phase shift at 94 GHz per unit of length in terms of the product $bk_0$.

The phase shift per unit of length as a function of parameter t/b with a given value of $bk_0$ can be deduced from the dispersion curves in FIG. 2. For a given insulated image guide, the phase shift curve per unit of length as a function of t can be plotted for a given operation frequency as shown in FIG. 3.

Taking the example of an insulated image guide consisting of a bar of alumina in the air operating at around 94 GHz, we have plotted the curve of phase shift Δφ in °/cm as a function of parameter t for two values of $bk_0$: 0.75 corresponding to b=0.38 mm, and 0.90 corresponding to b=0.45 mm. We observe that Δφ=360°/cm is obtained with a variation in the thickness of the air space from 10 microns to 50 microns for example.

The phase shift per unit of length is provided by the following relation:

$$\Delta\phi = |k_z(t_1) - k_z(t_2)|$$

where $k_z(t_1)$ and $k_z(t_2)$ designate propagation constants corresponding to air space thicknesses $t_1$ and $t_2$ respectively. Δφ is expressed in radians per centimeter when $k_z$ is in radians per centimeter. If the action of the air stream is applied to a l length of insulated image guide, the corresponding phase shift is equal to:

$$\Delta\phi_{rd} = l_{(cm)}|k_z(t_1) - k_z(t_2)|$$

The insertion losses and the impedance variation of such a device when the phase shift varies from 0° to 360° are assessed taking for example the case in which b=0.45 mm at 94 GHz. With t=10 microns, we obtain t/b=2.22% and with t=50 microns, t/b=11.11%.

The curves in FIG. 4 show that insertion losses vary from 25 dB/m to 10 dB/m, providing losses varying from 0.25 to 0.1 dB/cm; these insertion losses are quite negligible. This shows the phase shifter embodying the invention introduces practically no amplitude modulation whatever the phase shift.

Figure 5:
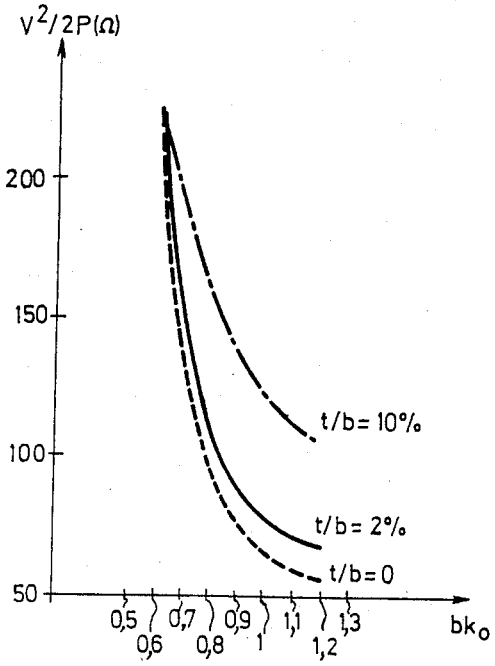
FIG. 5 shows the waveguide impedance as a function of the small side height b of the guide, for different values of the guide-reflector plane distance t.

As for the impedance defined by $V^2/2P$, with a phase shift varying from 0° to 360°, it increased from 90 to 140 ohms, i.e., a variation around the mean value of 22%, as shown in FIG. 5.

Figure 6:
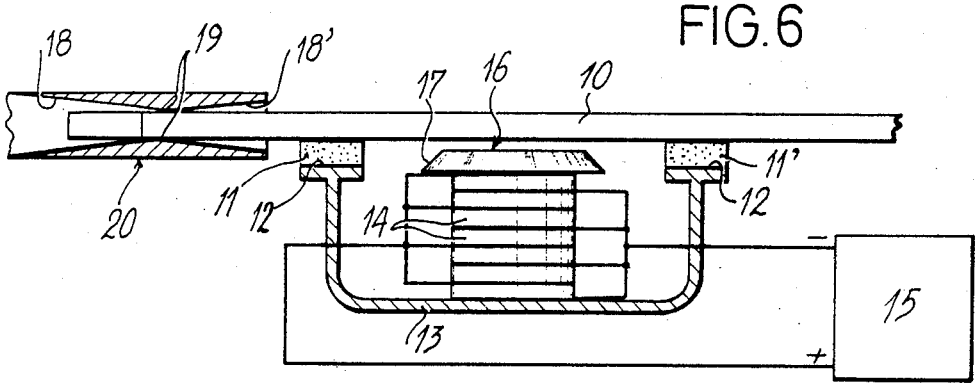
FIG. 6 shows a dielectric waveguide phase shifter with piezoelectric control, in accordance with the invention.

Referring to FIG. 6, a waveguide 10 in dielectric material or semiconductor material, such as AsGa, lies on two shims 11 and 11' in dielectric material having a low permittivity. Shims 11 and 11' lie on rim 12 of branches of a U-shapped holder 13. A stack of piezoelectric ceramic washers 14 is carried by a central plan portion of the holder. Electrodes of the washers are connected to two poles of a variable d.c. power source 15 respectively. A rectangular reflector plate 16 beveled in tapered sections 17 is secured to the top washer if the stack, by adhesive for example. The reflector plate is moved from a position remote from waveguide 10 to a position where the plate is applied against the large or major side of waveguide 10 as a function of the source voltage activating parallel-connected piezoelectric washers 14.

The tapered sections 17 are designed to take into account the variation in impedance with the guide/reflector plate distance.

If the millimeter-wave phase shifter is connected to a metal waveguide in $TE_{01}$ mode, the metal guide-dielectric guide transition in FIG. 6 can be used. This transition includes a gentle slope narrowing 18 from the height of the metal guide 20 followed by a gentle slope widening 18' of this same height. The narrowing and widening form a double truncated pyramid structure which provides a rectangular slot 19 in the metal guide. The dielectric guide 10 is inserted into slot 19. The slot is slightly greater than the height of the dielectric guide so as to provide for a clearance of at least a few hundred microns. The dielectric guide is thus excited in $Ey_{11}$ mode.

The dielectric guide phase shifter in FIG. 6 can be converted into a antenna or a antenna network by installing along the dielectric guide, means formed by radiator elements for disturbing the guided wave.

Figure 7:
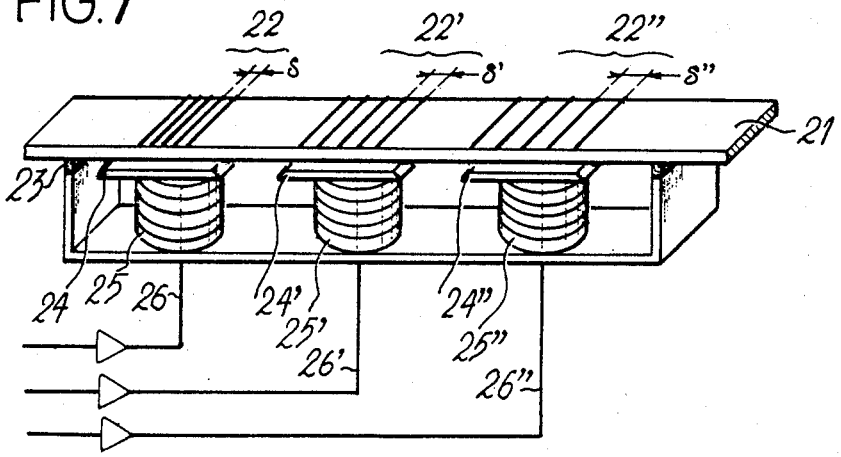
FIG. 7 shows a dielectric waveguide antenna network embodying the invention in which the form of the radiation pattern and position of the lobe are controlled by piezoelectric elements.

FIG. 7 shows an antenna network. On a dielectric waveguide 21 lying on U-holder branches via dielectric shims 23, parallel conductor strips 22 are transverse to the waveguide 21 and are divided into three equispaced groups separated by dielectric gaps. The strips form radiator perturbations. The radiation pattern of such a strip network depends, as is well known, on the number N of radiator elements, on the spacing n between elements measured in wavelength, and the phase shift p between adjacent radiator element. The radiation pattern is shown by the function $$G_p^{N,n}=\sin N(\pi p-\pi n\cos\alpha)/\sin(\pi p-\pi n\cos\alpha)$$

If $\delta$ denotes the gap between the strips, the phase shift between adjacent strips is $\phi=2\pi(\delta/\lambda_z)$, where $\lambda_z$ is the wavelength longitudinal to waveguide 21.

If $\lambda_z$ is varied via a conductor plane, a variation in the phase shift between strips is obtained and subsequently lobe scanning. The conductor strips form three groups 22, 22' and 22'' where the spacing between strips is $\delta$, $\delta'$ and $\delta''$ respectively. Three flat conductor plates 24, 24' and 24'' are provided below the three strip groups 22, 22' and 22'' respectively and are carried by three stacks of piezoelectric ceramic washers 25, 25' and 25'' respectively. The three stacks are activated by variable d.c. power sources 26, 26' and 26'' respectively. By suitable adjusting of the power sources, either a change in the radiation pattern of the antenna network or a lobe scanning is obtained.

Figure 8:
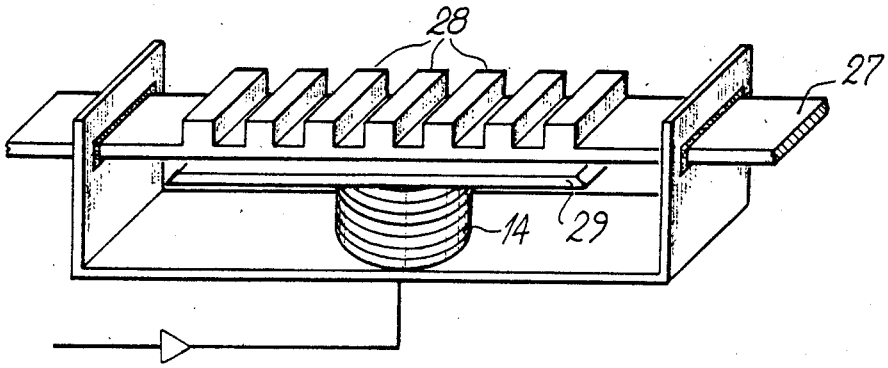
FIG. 8 is a dielectric waveguide antenna embodying the invention having disturbances formed by periodic corrugations, a lobe scanning being controlled by piezoelectric ceramic washers.

FIG. 8 shows a dielectric waveguide antenna 27 in which radiator perturbations are corrugations 28 of guide 27. Adjusting means of conductor surface 29 is analogous to that in FIG. 6, i.e. includes washers 14 in piezoelectric material.

The antenna network illustrated in FIG. 7 contains three independent guided-wavelength setting conductor planes, while the antenna network illustrated in FIG. 8 has a single conductor surface. The number of conductor planes having independent setting depends on antenna patterns to be obtained.

In the networks shown in FIGS. 6, 7 and 8, each guided-wavelength-setting conductor is displaced translationwise via a stack of piezoelectric ceramic washers. In practice, the translation may be a few ten to a few hundred microns. A stack of 40 piezoelectric washers having a total thickness of 8 cm obtains a displacement of 20 $\mu$m with a 700 V activation voltage.

We now describe the use of "piezoelectric biplates" which are shown on FIGS. **9*a* and 9*b*. A "voltage-deformation" characteristic of a piezoelectric biplate is indicated in FIG. 10**.

Figure 9A:
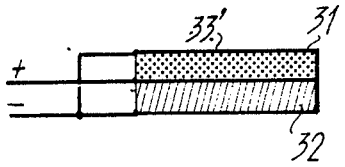
FIGS. 9*a* and 9*b* show disactived and actived conditions of a piezoelectric biplate respectively.
Figure 9B:
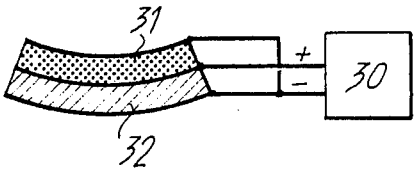

A biplate includes two piezoelectric washers or disks 31 and 32, as illustrated in FIGS. **9*a* and 9*b*, or two portions of washers forming two parallellepipedal members, supplied in opposition. When activated, the curvature of the biplate is modified as shown in FIG. 9*b*. An upper surface of washer 31 is metallized in a deposit 33'** which forms the conductor plane setting the guided wavelength. The movement of the conductor plane is no longer a translation as in the antenna networks previously described. The movement transforms a flat surface into a substantially spherical surface, convex or concave.

Figure 10:
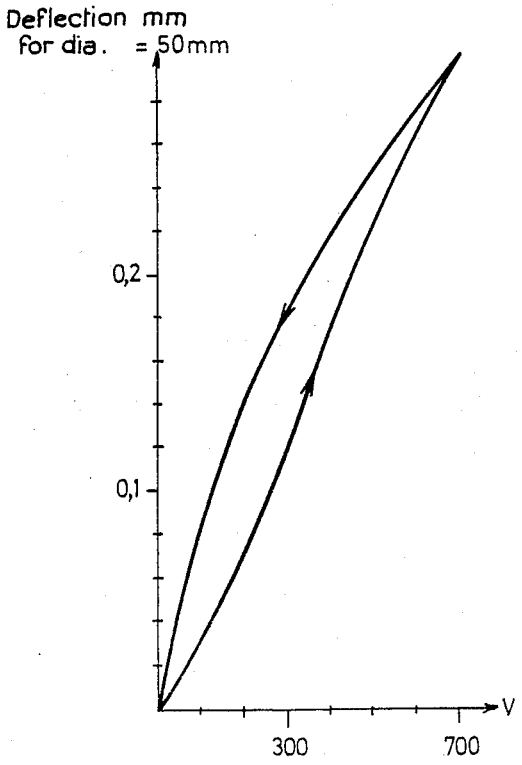
FIG. 10 shows a deformation curve of this biplate as a function of an applied voltage.
Figure 11B:
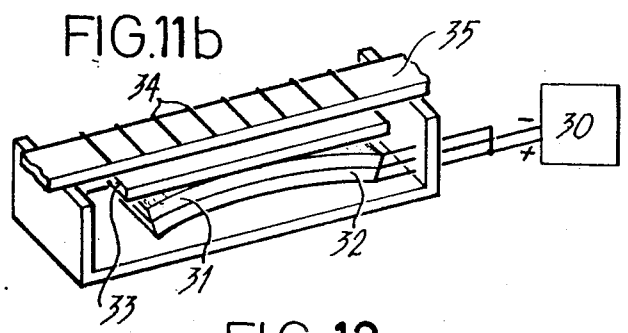
FIGS. 11*a* and 11*b* show two variable pattern antennae controlled by a piezoelectric biplate, respectively.
Figure 11A:
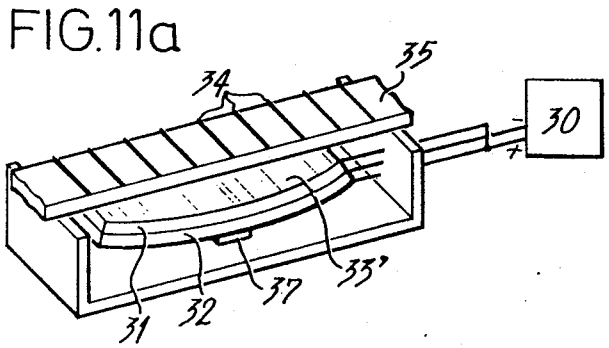

In FIG. 10 is shown the deflection in mm of a 50 mm diameter biplate, as a function of the power voltage in volts.

FIG. **11*a* shows an antenna in which the phase shifter from one radiator element to the next is different and variable. Strips 34 are provided on the dielectric waveguide 35. The conductor surface 33' consists of a metallized surface, of substantially concave form, of the upper face of a parallelepipedal biplate 31–32 which is mounted on a short post 37 and is supplied by the d.c. power source 30**.

FIG. **11*b* shows an antenna in which the phase shift from one radiator element to the next is the same and is variable. A conductor surface consists of a metal plate 33 cemented in the centre of the biplate 31–32 supplied by the d.c. power source 30**.

Figure 12:
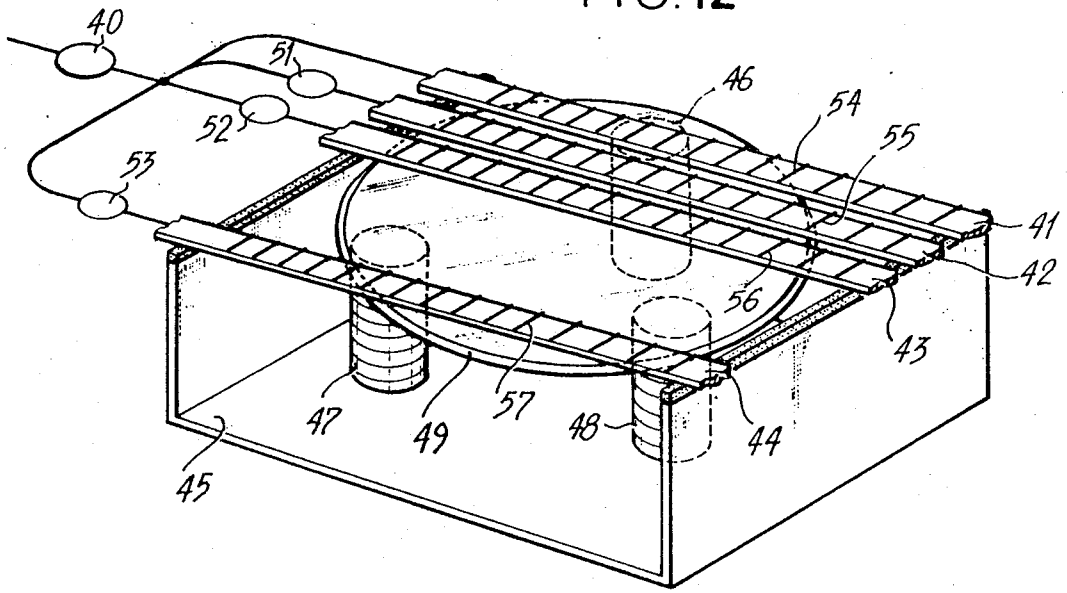
FIG. 12 shows an antenna network having tapered lobe setting in two different directions.

FIG. 12 shows a network of antennae in which the fineness and direction of the main lobe can be set according to two different rectangular coordinates.

On FIG. 12 a millimeter-wave generator 40 supplies a plurality of parallel and coplanar dielectric waveguides 41, 42, 43 . . . 44. The guides 41 to 44 are identical and parallel and are in-phase supplied directly and via phase shifters 51, 52 . . . 53 respectively.

Transverse parallel conductor strips 54, 55, 56 . . . 57 are formed, by metallization, on dielectric waveguides 41 to 44 respectively.

The stacks of piezoelectric washers 46, 47 and 48 are secured on a flat central portion a U-shapped holder 45 and are disposed at apexes of an equilateral triangle. A conductor plate 49 is secured to the upper washers of the three stacks. A variable d.c. power source sets the height of the piezoelectric stacks 46, 47 and 48. Plate 49 is generally horizontal, but owing to the variable height stacks, it can take on any inclination in any direction. These inclinations obviously are very slight.

In another embodiment, plate 49 is dielectric and, in the center of the equilateral triangle, a biplate is installed between plate 49 and the dielectric guides. An upper metallized washer of the biplate acts as reflector plane and can take on a spherical convex or concave form. This biplate can be everywhere spaced from the waveguides or be in contact with them at certain points and not at others. The d.c. power source then varies the deflection of the piezoelectric biplate.

In this way the radiation pattern of the antenna network can be set or, if the pattern remains practically the same, lobe scanning be applied.

Figure 14:
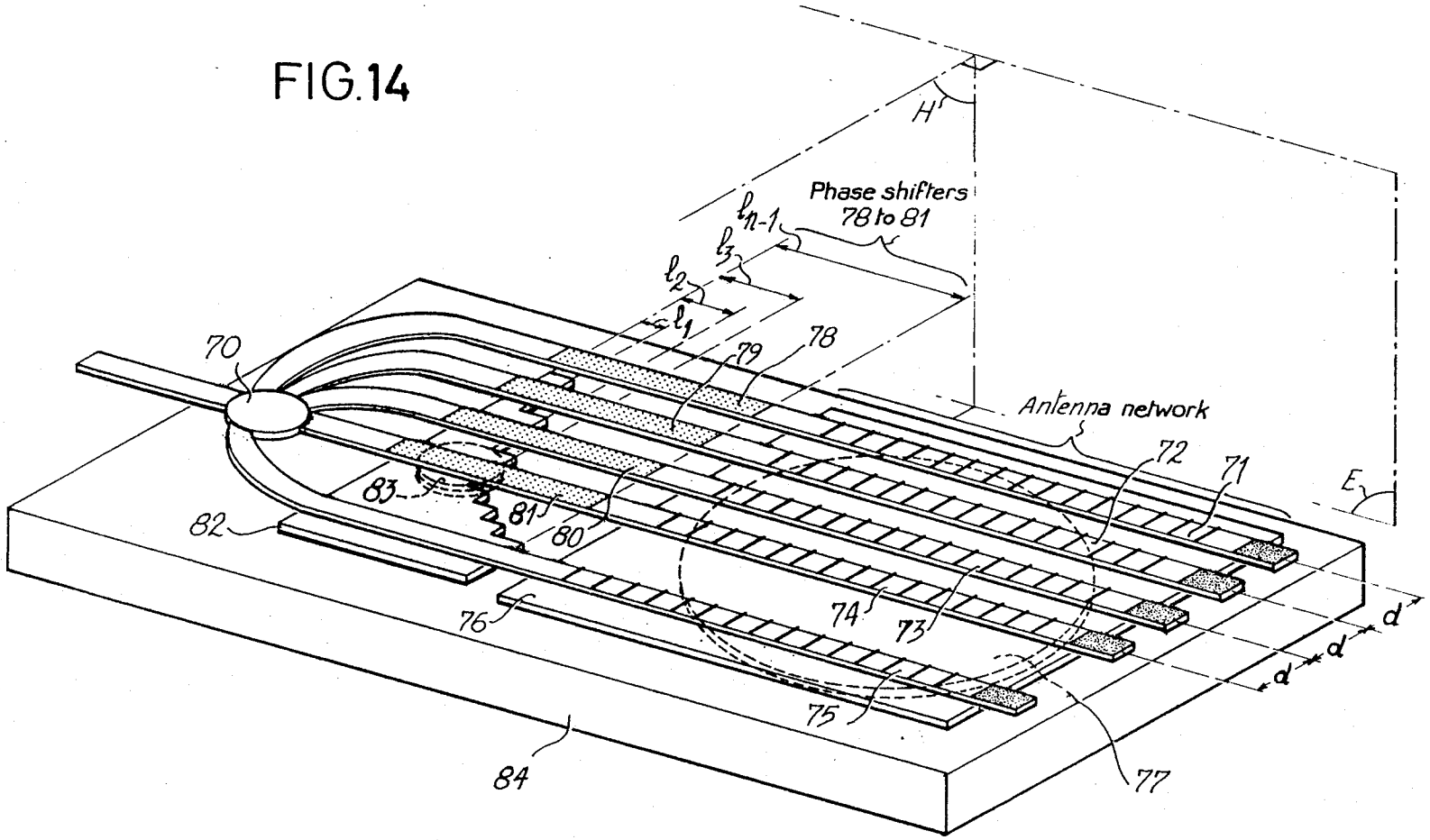
FIG. 14 shows an alternative embodiment of the antenna network in FIG. 12.

Still another embodiment of the antenna network in FIG. 12 is shown in FIG. 14. The antennae consist of parallel and coplanar dielectric waveguides 71, 72, 73, 74, . . . and 75 and a conductor plane or plate 76 supported by a biplate disk 77, and are supplied via a microwave power distributor 70 and an assembly of phase shifters 78, 79, 80, 81, . . . , respectively. The assembly of phase shifters consists of dielectric waveguides and a metal plane or plate 82 carried by a biplate disk 83 having electrical characteristics identical to or different from those of biplate 77. The two biplates 77 and 83 are supported by a stand 84. The metal plane 82 has n−1 notches forming a staircase and having lengths $l_1$, $l_2$, $l_3$ . . . $l_{n-1}$ in relation to n−1 waveguides such that:

$$l_2=2l_1$$

$$l_3=3l_1$$

$$l_{n-1}=(n-1)l_1$$

so as to provide a linear phase distribution $\Psi_1$, $\Psi_2$ . . . $\Psi_{n-1}$ such that:

$$\Psi_2=2\Psi_1$$

$$\Psi_3=3\Psi_1$$

$$\Psi_{n-1}=(n-1)\Psi_1$$

Plates 76 and 82 move parallel to their neutral position so as to provide respectively:

lobe scanning on each of the antennae, in a plane E parallel to the longitudinal axis of said antennae, and scanning in a plane H orthogonal to plane E and waveguides.

By two electrical controls independent of biplates 77 and 83, TV scanning type lobe scanning can then be obtained.

While we have described and illustrated embodiments relating to rectangular dielectric waveguides, it is to be understood that the invention is not limited thereto. Without departing from the spirit and scope of the invention, it can be provided dielectric waveguides of any form whatsoever having at least one flat wall or side, such as guides having a straight semi-cylindrical section, the moving metal wall carried by the piezoelectric means being more or less close to the flat wall.

Figure 13:
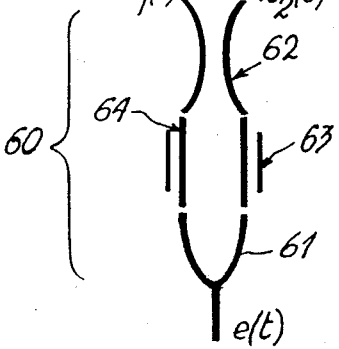
FIG. 13 shows a variable power divider controlled by a phase shifter embodying the invention.

The invention also applies to the embodiment of a variable power divider 60 as shown schematically in FIG. 13. Power divider 60 comprises a 3 dB Y-shaped coupler 61 and a hybrid 3 dB coupler 62 connected together via two adjustable phase shifters 63 and 64 according to the invention.

What we claim is:

1. A microwave phase shifter comprising a dielectric waveguide having a flat side and periodic spaced perturbations for transforming said waveguide into an antenna, a moving conductor plane member substantially parallel to said flat side of said waveguide and movable in relation to an area in said waveguide containing said perturbations, means for moving said plane member in relation to said waveguide between a remote position from said waveguide side and another position substantially in contact with said waveguide side, said moving means including a piezoelectric means carrying said conductor plane member, and variable power means supplying said piezoelectric means for varying at least a dimension of said piezoelectric means.

2. The phase shifter claimed in claim 1 wherein said perturbations are conductor strips on said dielectric waveguide.

3. The phase shifter claimed in claim 1 wherein said perturbations are corrugations of said dielectric waveguide.

4. A microwave phase shifter comprising a dielectric waveguide having a flat side, a moving conductor plane member substantially parallel to said flat side of said waveguide, and means for moving said plane member in relation to said waveguide between a remote position from said waveguide side and another position substantially in contact with said waveguide side, said moving means including a piezoelectric means carrying said conductor plane member, said piezoelectric means including a piezoelectric biplate having two piezoelectric members activated by equal and opposing electric fields, one of said piezoelectric members carrying said conductor plane member as a top element of the biplate, said conductor plane member being formed through metallization of a face of one of said two piezoelectric biplate members facing said waveguide, and a variable power means supplying said piezoelectric means for varying at least a dimension of said piezoelectric means.

5. A microwave phase shifter comprising a dielectric waveguide having a flat side, a moving conductor plate parallel to said flat side of said waveguide, a stack of piezoelectric members, an upper member of said stack carrying said conductor plate, a variable voltage supply means for supplying said piezoelectric members, the supply means voltage being adjustable to modify at least a dimension of said piezoelectric members to thereby move said conductor plate between a position remote from said waveguide side and another position substantially in contact with said waveguide side, and conductor strips on and transverse to said waveguide and equally distributed in a waveguide portion facing said conductor plate.

6. A microwave phase shifter comprising a dielectric waveguide having a flat side, a moving conductor plate parallel to said flat side of said waveguide, a stack of piezoelectric members, an upper member of said stack carrying said conductor plate, a variable voltage supply means for supplying said piezoelectric members, the supply means voltage being adjustable to modify at least a dimension of said piezoelectric members to thereby move said conductor plate between a position remote from said waveguide side and another position substantially in contact with said waveguide side, and periodic corrugations lodged in a waveguide area facing said conductor plate.

7. A microwave phase shifter comprising a dielectric waveguide having a flat side, a moving conductor member substantially flat and parallel to said waveguide side, conductor strips on and transverse to said waveguide area facing said conductor member, two stacked piezoelectric members facing a piezoelectric biplate, one of said piezoelectric members facing said waveguide side and carrying said conductor member, and a variable voltage supply means activating said two piezoelectric members by equal and opposing electric fields, the supply means voltage being adjustable to modify curvature of said biplate thereby moving said conductor member between a position remote from said waveguide side and another position substantially in contact with said waveguide side.

8. The phase shifter claimed in claim 7 wherein said conductor member includes a conductor plate secured substantially to the centre of said piezoelectric member facing said waveguide side.

9. The phase shifter claimed in claim 8 wherein said conductor member comprises a metallic deposit on a face of said piezoelectric member facing said waveguide side.

10. A microwave phase shifter comprising a dielectric waveguide having a flat side, a moving conductor member substantially flat and parallel to said waveguide side, periodic corrugations in a waveguide position facing said conductor member, two stacked piezoelectric members facing a piezoelectric biplate, one of said piezoelectric members facing said waveguide side and carrying said conductor member, and a variable voltage supply means for activating said two piezoelectric members by equal and opposing electric fields, the supply means voltage being adjustable to modify curvature of said biplate thereby moving said conductor member between a position remote from said waveguide side and another position substantially in contact with said waveguide side.

11. The phase shifter claimed in claim 10 wherein said conductor member includes a conductor plate secured substantially to the centre of said piezoelectric member facing said waveguide side.

12. The phase shifter claimed in claim 11 wherein said conductor member includes a metallic deposit on a face of said piezoelectric member facing said waveguide side.

13. A microwave phase shifter comprising a dielectric waveguide having a flat side a plurality of moving conductor plane members substantially parallel to and facing said waveguide side, a plurality of piezoelectric member stacks carrying said conductor plane members respectively, a plurality of perturbation groups disposed in waveguide positions facing to said conductor planes respectively, said perturbations in each of said groups being equispaced by a predetermined distance, and a plurality of variable voltage supply means supplying said piezoelectric member stacks respectively, the voltage of each of said supply means being adjustable to modify at least a dimension of the piezoelectric members in the respective stack thereby moving the respective conductor member between a position remote from said waveguide side and another position substantially in contact with said waveguide side.

14. The phase shifter claimed in claim 13 wherein said perturbations in each of said groups are parallel conductor strips on said waveguide.

15. The phase shifter claimed in claim 13 wherein said perturbations in each of said groups are corrugations in said waveguide.

16. An antenna network comprising a plurality of parallel dielectric waveguides having coplanar flat sides, a moving conductor plane member substantially parallel to and facing said coplanar waveguide sides, at least one piezoelectric means carrying said conductor plane member, a plurality of radiator perturbation groups disposed in waveguide portions facing to said conductor plane, said radiator perturbations in each of said waveguides being equispaced by predetermined distance, and a variable voltage supply means supplying said piezoelectric means with a variable voltage that is adjustable thereby moving said conductor member with respect to said waveguide sides.

17. The antenna network claimed in claim 16 wherein said radiator perturbations are parallel conductor strips transverse to said waveguide portions.

18. The antenna network claimed in claim 16 wherein said radiator perturbations are corrugations formed in said waveguide portions.

19. The antenna network claimed in claim 16 wherein said piezoelectric means is a stack of piezoelectric members supplied by said supply means.

20. The antenna network claimed in claim 16 wherein said piezoelectric means includes two stacked piezoelectric members supplied by said supply means to be activated by equal and opposing electric fields.

21. The antenna network claimed in claim 20 wherein said conductor member has a centre area secured to one of said piezoelectric members.

22. The antenna network claimed in claim 20 wherein said conductor member is a metallic deposit on a face of one of said piezoelectric members.

23. The antenna network claimed in claim 16 wherein said piezoelectric means comprise three piezoelectric member stacks carrying said conductor plane member, and said variable voltage means comprise three d.c. power sources supplying said piezoelectric member stacks respectively.

24. An antenna network as claimed in claim 16 comprising microwave power distributing means for supplying said dielectric waveguides, and a plurality of variable phase shifters interconnected between said microwave power distributing means and ends of said dielectric waveguides respectively, said plurality of variable phase shifter including a plurality of second coplanar dielectric waveguides, a metal plate and a second piezoelectric means carrying said metal plate facing said second dielectric waveguides.

25. The antenna network claimed in claim 24 wherein said second waveguides have portions facing portions of said metal plate having different lengths respectively.

* * * * *